US006056680A

United States Patent [19]

Spronk-Dik

[11] Patent Number: 6,056,680

[45] Date of Patent: May 2, 2000

[54] METHOD FOR MANUFACTURING AN AIRTIGHT AND MOISTURE-PROOF CARDBOARD BOX

[75] Inventor: Anna Spronk-Dik, Haven, Netherlands

[73] Assignee: Crystal B.V., Almere, Netherlands

[21] Appl. No.: 09/117,035

[22] PCT Filed: Jan. 20, 1997

[86] PCT No.: PCT/NL97/00020

§ 371 Date: Aug. 31, 1998

§ 102(e) Date: Aug. 31, 1998

[87] PCT Pub. No.: WO97/32788

PCT Pub. Date: Sep. 12, 1997

[30] Foreign Application Priority Data

Jan. 23, 1996 [NL] Netherlands ..... 1002161

[51] Int. Cl.[7] ..... B31B 1/62

[52] U.S. Cl. ..... 493/151; 493/128; 493/96

[58] Field of Search ..... 493/148, 150, 493/151, 128, 132, 94, 95, 96, 97, 331, 333, 336, 337; 229/125.34

[56] References Cited

FOREIGN PATENT DOCUMENTS 1575482 9/1980 United Kingdom .

*Primary Examiner*—John Siros
*Assistant Examiner*—Steven Jensen
*Attorney, Agent, or Firm*—Oblon, Spivak, McClelland, Maier & Neustadt, P.C.

[57] ABSTRACT

A method for manufacturing an airtight box from cardboard. The box has side wall panels and end wall panels. After a blank has been cut out, a flexible material strip is connected with the side wall panels and a number of end wall panels through adhesion. The material strip is attached to each of a number of other end wall panels while leaving clear two triangular portions not provided with adhesive which are located adjacent the free edges of the corresponding end panel. The blank is then erected to form a box through folding and adhesion with the adhesive being applied to the blank by at least one stamp. The stamp is of such design that the adhesive layer on the relevant end wall panel terminates at some distance from the edge of the adjacent end wall panel.

14 Claims, 7 Drawing Sheets

METHOD FOR MANUFACTURING AN AIRTIGHT AND MOISTURE-PROOF CARDBOARD BOX

BACKGROUND OF THE INVENTION

1. Field of the Invention

The present invention relates generally to a method for making a cardboard box and more particularly to method for manufacturing an airtight and moisture-proof cardboard box and the box obtained.

2. Discussion of the Background

Such a method is known from British patent GB-B-2,155,908. The subject matter of this publication is considered to form part of the specification of the present application.

A problem of the known box resides in the application of the adhesive by means of which the material strip is attached to the blank. This problem occurs in particular when the box is to be mass-produced. The end panels to which the material strip is attached at least substantially completely must be accurately provided with adhesive over the entire area over which the material strip extends, without adhesive thereby ending up on the adjacent end panels. This is of particular importance because if adhesive ends up on the adjacent end panels, it is no longer possible to temporarily fold these adjacent end panels outwards while simultaneously folding inwards the end panels to which the material strip is attached at least substantially completely. When this situation occurs in an automatic manufacturing process, the manufacturing process halts, which leads to great losses. The application of the adhesive to the end panels is therefore particularly critical. In general, the adhesive is applied by means of a stamp under which the blank from which the box is manufactured should be positioned accurately. It is found in practice that in mass production, that is, in the production of about 20,000–30,000 boxes per hour, the position of the blank under the adhesive stamp can vary by about 1.5 mm. Accordingly, the problem presenting itself is that it is not possible for airtight and moisture-proof boxes as described in GB-B-2,155,908 to be mass-produced.

Owing to the adhesive layer on the relevant end wall panel terminating some distance from the edge of the adjacent end wall panel, adhesive is prevented from ending up, during the application of the adhesive to those relevant end wall panels, on the adjacent end wall panels. In practice, this means that in the case of an end wall panel that is bounded on both edges by an adjacent end wall panel, the width of, for instance, the stamp or a like facility for applying the adhesive to that end wall panel, is slightly less than the distance between the two sidewall fold lines of the sidewall panel to which the end wall panel in question is connected. The measures according to the invention preclude the possibility of the manufacturing process halting as a result of the fact that the situation occurs where it is not possible to temporarily fold the adjacent end panels outwards while simultaneously folding inwards the end panels with which the material strip is at least substantially completely connected.

SUMMARY OF THE INVENTION

The recesses provided at the two edges of the end wall panel, which are so wide that adhesive for the purpose of attaching the material strip to the relevant end wall panel is exposed at that point in that it is squeezed out at that point between the end wall panel and the material strip, provide, firstly, that the relevant end wall panels, at the location of these recesses, are provided with adhesive over the entire width, so that at that point between the end wall panel and the material strip no formation of leakage tunnels is possible. Because moreover the adhesive for the purpose of interconnecting the end wall panels is applied so as to be in communication with the above-mentioned exposed material strip attachment adhesive, the formation of leakage tunnels is prevented during folding as well, since at the location of the points where a leakage tunnel might form the glue for the purpose of securing the end wall panels is in communication with the glue for the purpose of attaching the material strip. Accordingly, in the leakage tunnel, if any is present, there is a "glue dam" at the location of the recess, which seals the leakage tunnel hermetically.

BRIEF DESCRIPTION OF THE DRAWINGS

Further elaborations of the invention are described in the subclaims and will be further clarified on the basis of a number of exemplary embodiments, with reference to the drawing.

DETAILED DESCRIPTION OF THE PREFERRED EMBODIMENTS

FIGS. 1–4 and 1*a*–4*a* show, respectively, a cross-sectional view and a top plan view of four different blanks. Each blank P represented comprises a number of sidewall panels 1–4 which are mutually connected through sidewall fold lines 5–7. The blank P further has a number of end wall panels 8–11 which are attached to the sidewall panels 1–4 through end wall fold lines 13–16, respectively. The end wall panels 8–11 are each bounded by two opposite free edges 8*a*, 8*b*,

9*a*, 9*b*, 10*a*, 10*b*, 11*a*, 11*b* and a free end wall edge 17–20 located opposite the end wall fold line 13–16. After the blank P has been cut out, at the location of the or each end wall fold line 13–16 a flexible material strip S is connected at least substantially completely with the sidewall panels 1–4 and a number of end wall panels 8, 10 through adhesion. In addition, the material strip S is attached to each of a number of other end wall panels 9, 11 while leaving clear two triangular portions 21, 22, 23, 24 not provided with adhesive, located adjacent the free edges 9*a*, 9*b*, 11*a*, 11*b* of the corresponding end panel 90, 11. Then the blank P is erected into a box through folding and adhesion.

Figure 1:
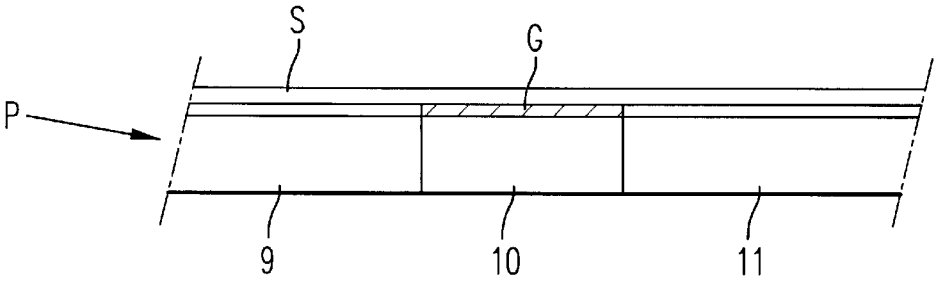
FIG. 1 PRIOR ART
FIG. 1 shows a cross-sectional view of the top plan view shown in FIG. 1*a* of a blank with a material strip attached to the blank in the manner as known from the prior art.
Figure 1A:
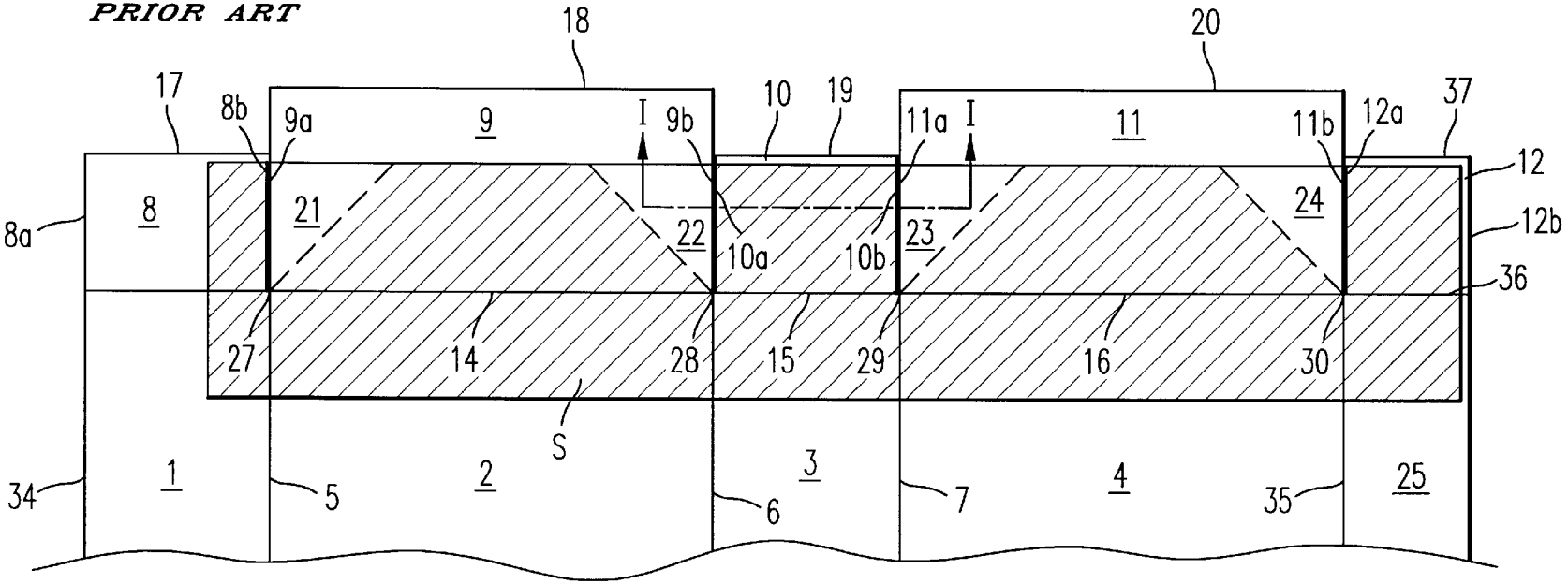
FIG. 1a PRIOR ART

The blank P, S represented in FIGS. 1 and 1*a* is known from GB-B-2,155,908. As is shown clearly in FIG. 1*a*, the edges 8*b*, 9*a*; 9*b*, 10*a* and 10*b*, 11*a* are in close mutual adjacency and the width of the area provided with adhesive G corresponds accurately with the width of the relevant end wall panel 10. This applies equally at the location of the edge 8*b* of the end wall panel 8 and at the location of the edge 12*a* of the end wall panel 12 which is connected with an adhesive panel 25. In order to ensure that the end wall panels 8 and 10 can be folded into their end position without difficulty, it is essential that no adhesive G of an end wall panel 8, 10 to which the material strip S is attached at least substantially completely, ends up on the adjacent end wall panels 9, 11, to which the material strip S is attached only partly. Particularly in the mass production of the boxes, this is not feasible when the width of, for instance, the stamp with which the adhesive G is applied corresponds with the width of the end wall panel 8, 10 to which the adhesive G is to be applied. Mass production of boxes which are manufactured from a blank with a material strip S arranged thereon in a known manner as represented in FIGS. 1, 1*a* is therefore not possible.

In order to solve this problem, the method according to the invention is characterized in that the adhesive G for the purpose of adhering the material strips S to the blank P is applied to the blank P in such a manner that the adhesive layer G on the relevant end wall panel 8, 10, 12 terminates at some distance from, respectively, the edge 9*a* and 9*b*, and 11*a* and 11*b* of the adjacent end wall panel 9 and 11, 12, respectively. Such an embodiment is represented clearly in FIGS. 2, 2*a*, 3, 3*a*, 4 and 4*a*.

Figure 2:
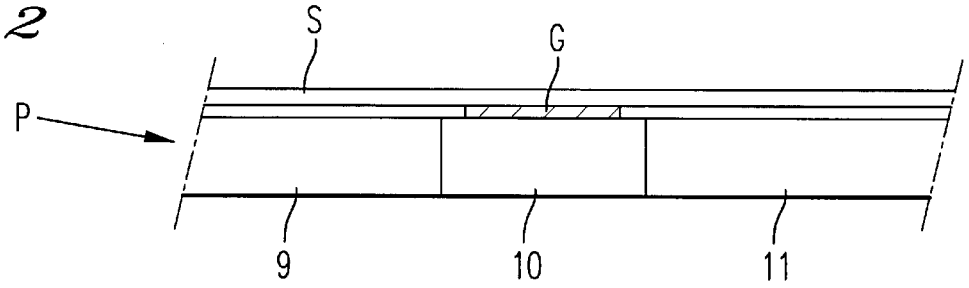
FIG. 2 shows a similar cross-sectional view to FIG. 1, with the adhesive for the purpose of attaching the material strip to the end panel terminating some distance from the edges of the adjacent end wall panels.
Figure 2A:
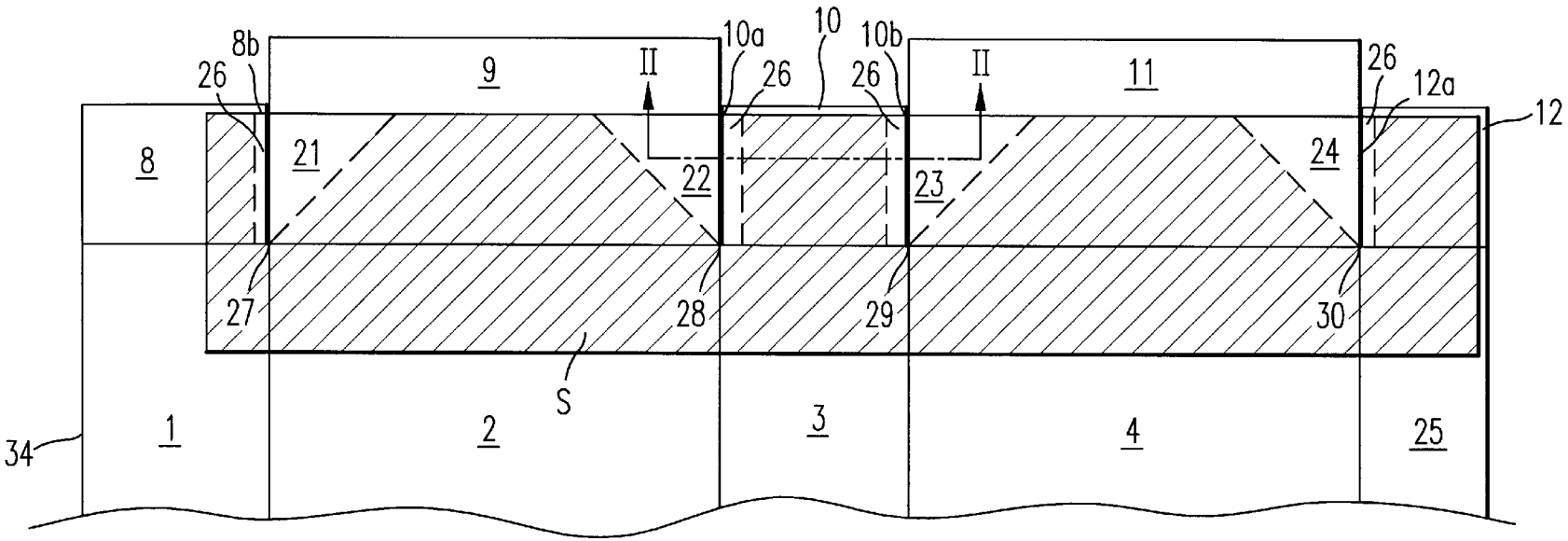
FIG. 2*a* shows a top plan view of the blank shown partly in cross section in FIG. 2.

The embodiment most similar to the prior art is represented in FIGS. 2 and 2*a*, where the blank P is designed in a known manner. That is, the edges 8*b*, 9*a*, 9*b*, 10*a*, 10*b*, 11*a*, 11*b* of the end panels 8, 9, 10, 11 are closely adjacent to each other. Only the manner in which the adhesive layer G has been applied has been modified. As has already been indicated in the introduction to the specification, this embodiment still entails a slight chance of leakage. Owing to the fact that the material strip S is not connected with the panels 8 and over the full wide thereof, a so-called leakage tunnel 26 can form, along which air or liquid can flow from the relevant corner point 27, 28, 29, 30 of the box to the box interior.

In order to preclude this chance of leakage entirely, according to a further elaboration of the invention, recesses 31, 32 are provided at the location of the edges 8*b*, 10*a*, 10*b*, 12*a* of the end wall panels 8, 10, 12 bounding an adjacent end wall panel 9, 11, these recesses 31, 32 being so wide that adhesive G for the purpose of attaching the material strip S to the corresponding end wall panels 8, 10, 12 will become exposed there in that the adhesive at that point, as the material strip S is being rolled on, will be squeezed out between the blank P and the material strip S. During erection into a box, adhesive 33 for the purpose of interconnecting the end wall panels 8, 9, 10, 11 is applied in such a manner that this adhesive 33 is in communication with the exposed material strip attachment adhesive Gv. Owing to the adhesive 33 for the purpose of interconnecting the end wall panels 8–11 being applied so as to be in communication with the exposed material strip attachment adhesive Gv, the formation of leakage tunnels 26 during the folding up of the end wall panels 8–11 is prevented as well. For at the location of the points where a leakage tunnel 26 might form, the adhesive 33 for the purpose of fixing the end wall panels 8, 9, 10, 11 is in communication with the adhesive Gv for the purpose of attaching the material strip S. Accordingly, in the leakage tunnel 26, if any is present, there is a "glue dam" at the recess 31, 32, which "glue dam" seals the leakage tunnel 26 in a liquid-tight and airtight manner.

Figure 3:
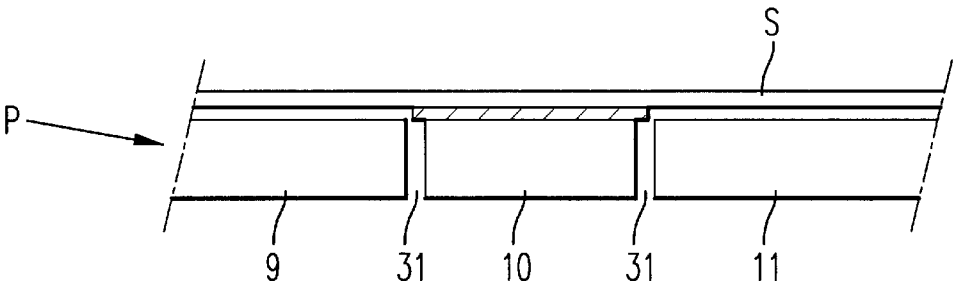
FIG. 3 shows a similar cross-sectional view to FIG. 1, where the end wall panels to which the material strip is attached at least substantially completely are provided with recesses which extend over the entire length of the edges of those end panels.
Figure 3A:
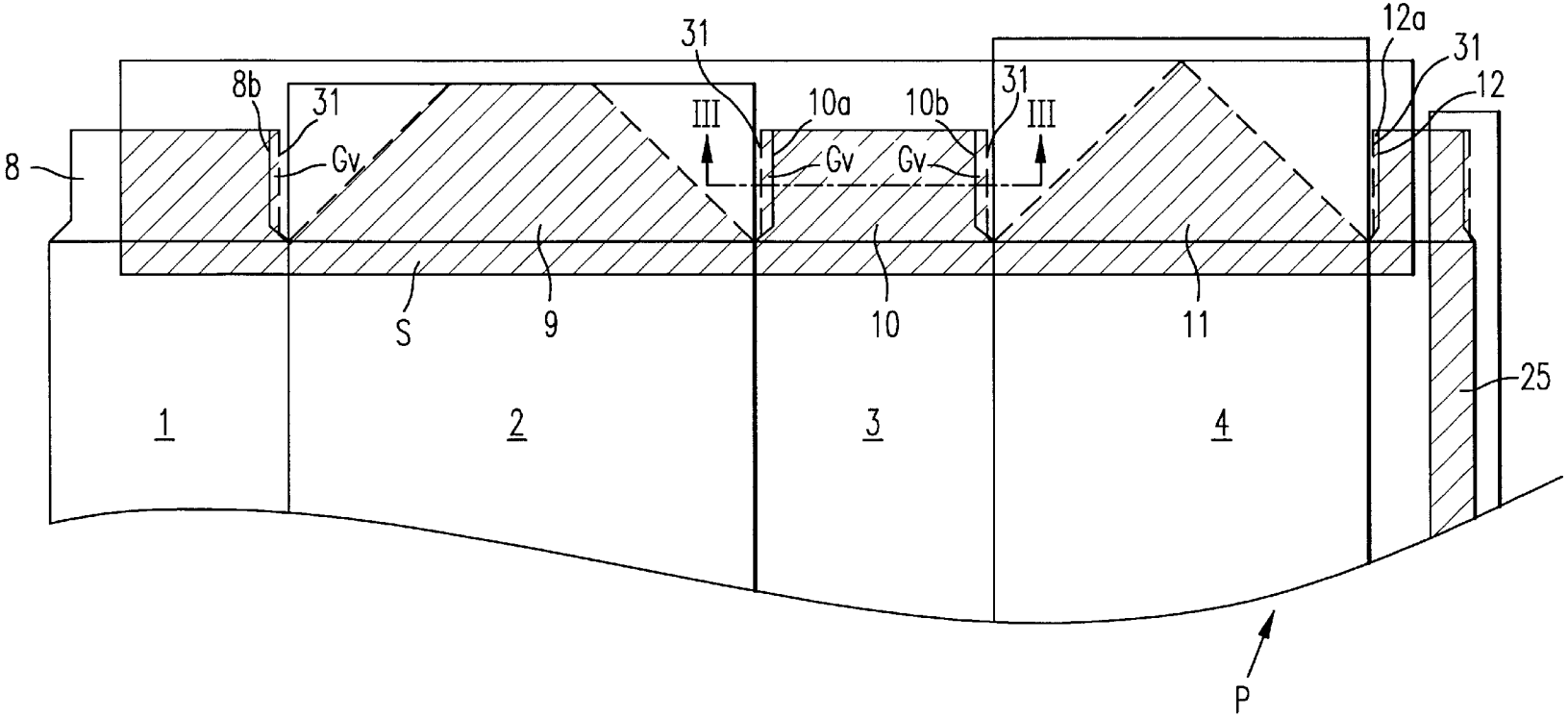
FIG. 3*a* shows a top plan view of the blank shown partly in cross section in FIG. 3.
Figure 4:
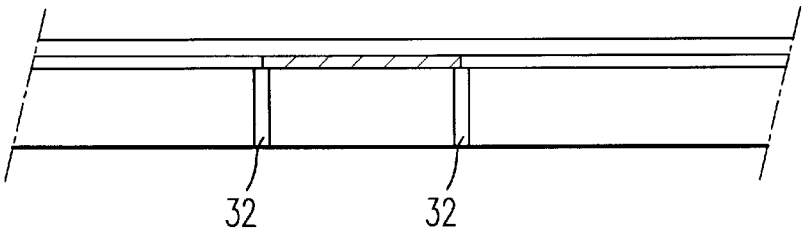
FIG. 4 shows a cross-sectional view as represented in FIG. 1, where the end wall panels to which the material strip is attached at least substantially completely are provided with recesses extending over a part of the length of the edges of those end panels.
Figure 4A:
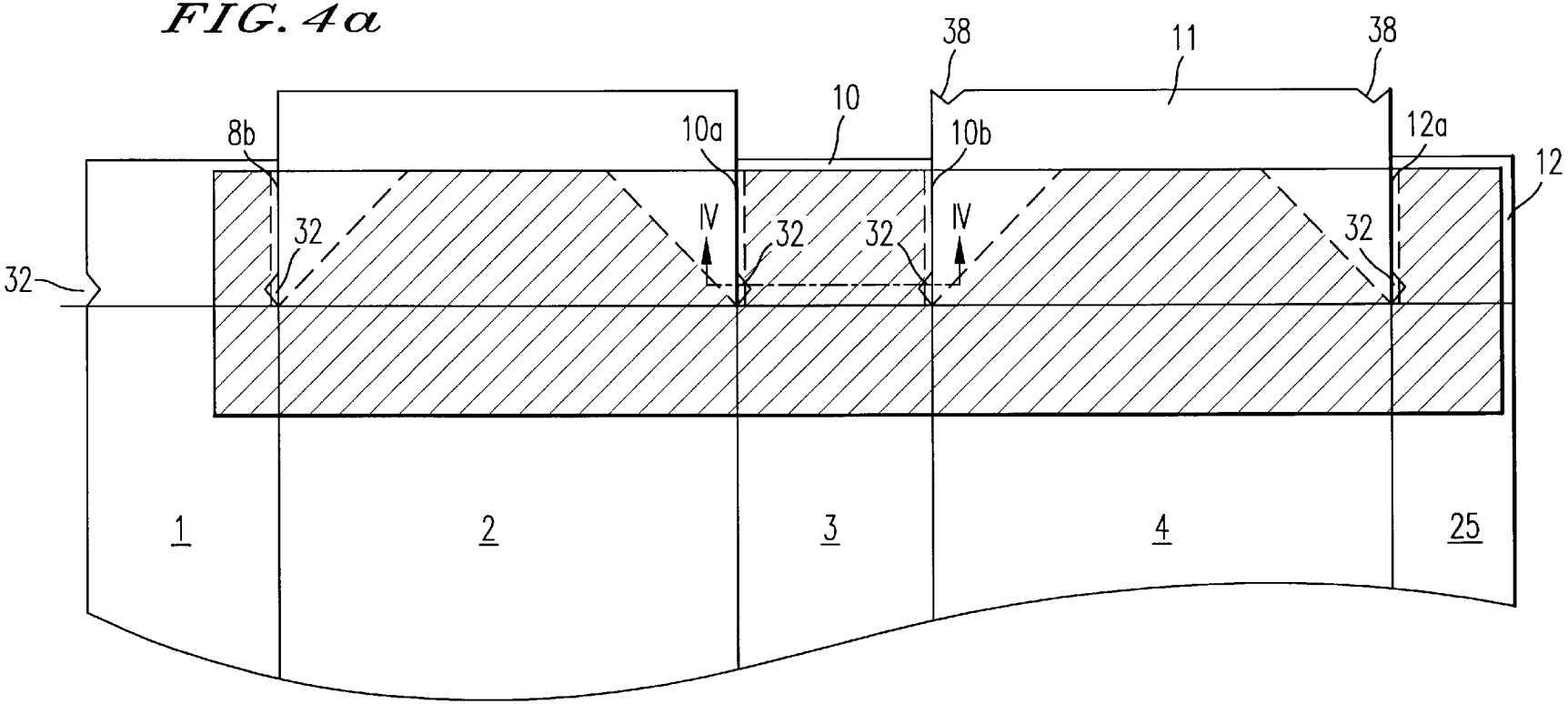
FIG. 4*a* shows a top plan view of the blank shown partly in cross section in FIG. 4.
Figure 5:
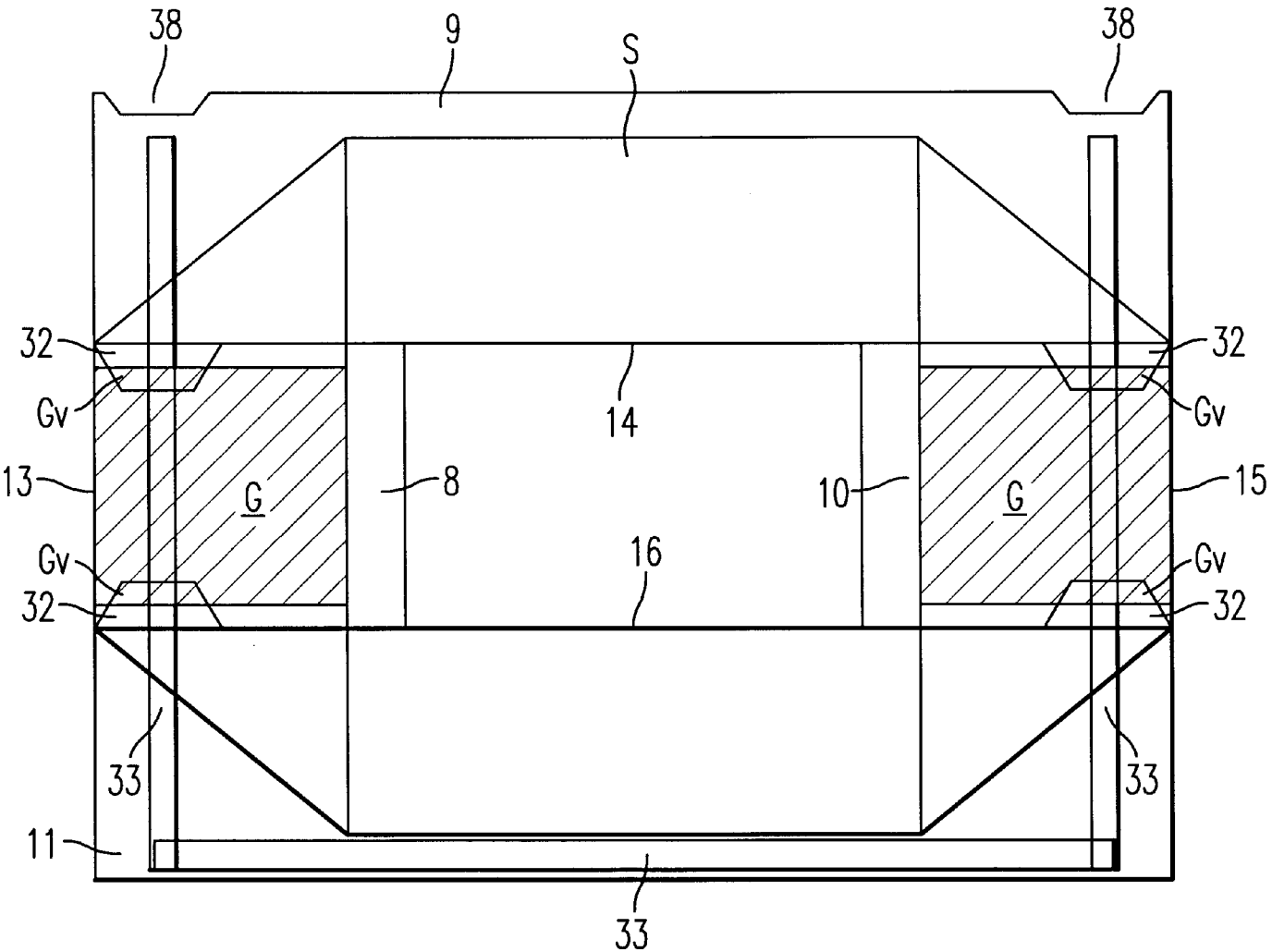
FIG. 5 shows a top plan view of a partly erected box, where two end panels are disposed in an outwardly folded position and two end panels are disposed in an inwardly folded position.
Figure 6:
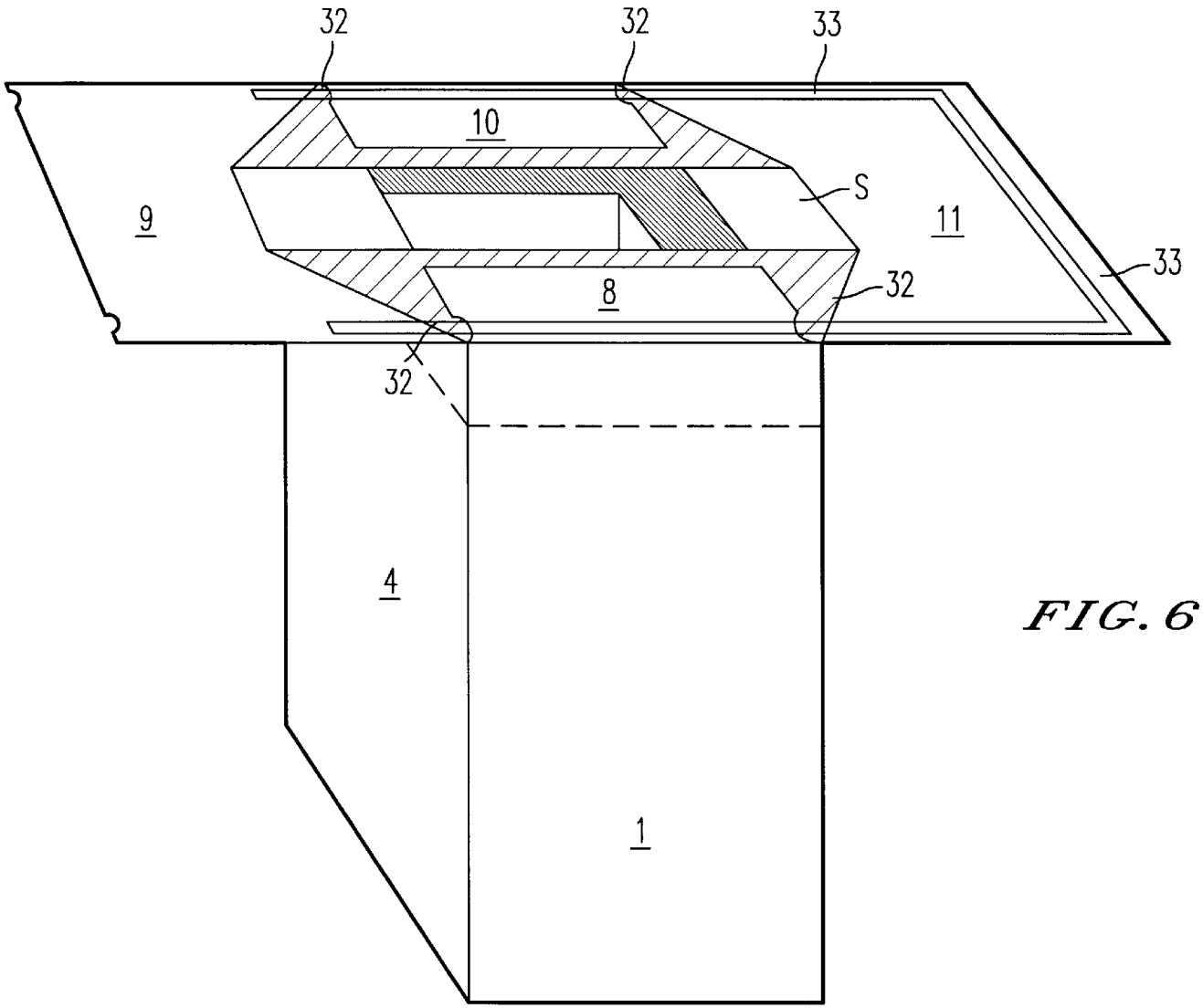
FIG. 6 shows a perspective view of the box in partly erected position as shown in top plan view in FIG. 5.

As represented in FIG. 3, the recess 31 can extend over the entire length of the edges 8*b*, 10*a*, 10*b*, 12*a* of the end wall panels. In the case of the end wall panel 10, which is bounded on both sides by an adjacent end panel 9, 11, the distance between the free edges 10*a*, 10*b* of that end panel 10 is slightly less than the width of the associated adhesive stamp or like adhesive applicator. It is thus provided that the end wall panel 10 in question is always completely provided with an adhesive layer G. As a result of rolling the material strip S onto the blank P, the adhesive G is squeezed out at the location of the recesses 31 and at that point the adhesive layer G then projects beyond the edges 10*a*, 10*b* on opposite sides of the end wall panel 10. As the end wall panel 10 is folded inwards, the material strip S is also adhered to the cut edges 10*a*, 10*b* and connected hermetically and liquid-tightly to them. A small disadvantage of the recess 31 extending over the entire length of the edges 8*b*, 10*a*, 10*b*, 12*a* is that the box may deform or slant somewhat more easily.

In order to increase the stiffness of the box even further, the method is characterized, according to an alternative further elaboration, in that the distance between the edges 8*a*, 8*b*, 10*a*, 10*b* of those end wall panels 8, 10 to which the material strip S is attached virtually completely is substantially equal to the distance between the sidewall fold lines or sidewall edge 34, 5, and 6, 7 of the sidewall panels 1 and 3, respectively, with which the relevant end wall panels 8 and 10, respectively, are connected, while the or each recess 32 extends only over a part of the total length of the relevant edge 8*b*, 10*a*, 10*b*. Owing to the fact that the relevant edges 8*a*, 8*b*, 10*a*, 10*b* in the folded condition of the box, apart from the recess 32, abut against the end wall fold lines 14, 16, the possibility of slanting is reduced to a minimum.

In all the exemplary embodiments shown, the blank P is further provided with an adhesive panel 25 which is connected via an adhesive panel fold line 35 to a longitudinal edge of a sidewall 4 located at a free end of the blank P. By means of the adhesive panel 25, the two sidewalls 1, 4 located at the free ends of the blank P can be interconnected through adhesion. The adhesive panel 25 is connected via an end wall fold line 36 to at least one end wall panel 12 with two opposite edges 12*a*, 12*b* and a free end edge 37 located opposite the end wall fold line 36. In order to prevent the formation of any leakage tunnel 26 at this corner point 30 as well—since on this end panel 12 too the adhesive layer G terminates at some distance from the edge 11*b* of the adjacent end wall panel 11—the edge 12*a* of the end panel 12, which is proximal to the adjacent end wall panel 11, is also provided with a recess 31, 32 of the above-mentioned type.

According to a further elaboration of the method according to the invention, the result of which is represented in FIGS. 2–8, the blank comprises four sidewall panels 1–4 and, at least at one end, four, first through fourth, end wall panels 8–11 connected to the sidewall panels 1–4. When erecting the box by folding and adhesion, first the sidewalls 1, 4 located at the ends of the blank P are connected to each other. Then the first and the third end wall panels 8, 10 to which the material strip S is attached at least substantially completely are folded inwards and the second and fourth end wall panels 9, 11 are folded outwards to some extent. Then the adhesive 33 for the purpose of joining together the end wall panels 8–11 is applied and then the second end wall panel 9 and, lastly, the fourth end wall panel 11 is brought into the end position.

It is clear that a box with more or fewer than four sidewalls also falls within the scope of the invention. In the exemplary embodiments shown, with a view to saving adhesive, only a narrow ribbon of adhesive 33 is used for the purpose of securing the end walls 8, 9, 10, 11. It will be clear, however, that it is also possible to apply adhesive 33 to the entire surface of the end wall panels 8–11 visible in FIG. 5. To achieve a proper seal, however, this is not necessary.

If the second end wall panel 9 has a height which corresponds with the width of the sidewall 1, 3 associated with the first and third end walls 8, 10, it is possible, in accordance with a further elaboration of the invention, for this second and wall panel 9 to be provided at the free end edge 18 thereof with two recesses 38, which prevents the exposed material strip adhesive Gv from being covered as the second end wall panel 9 is brought into the end position. In this connection, the height of the end wall panel 9 is understood to indicate the distance between the free edge 18 and the end wall fold line 14.

Figure 7:
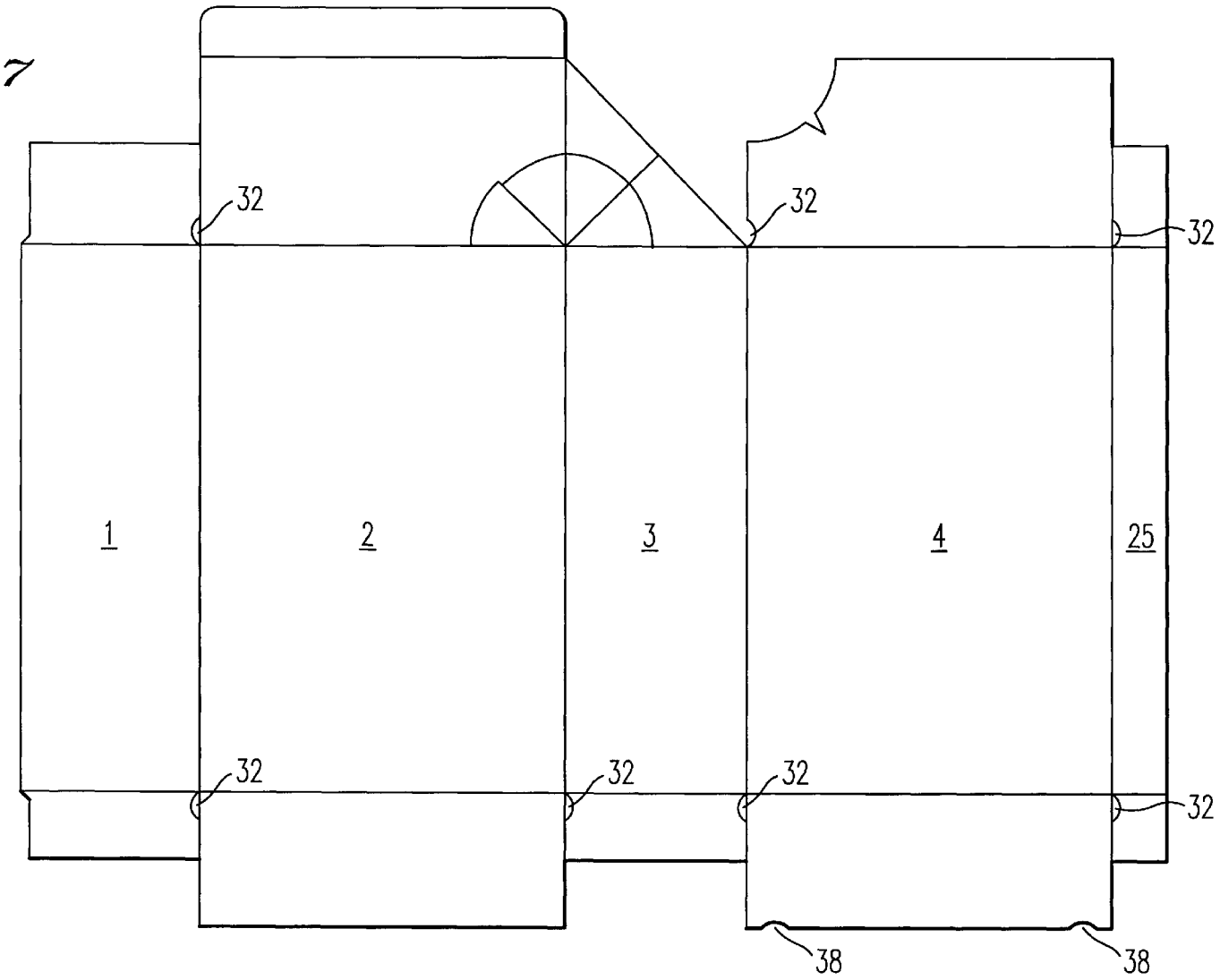
FIG. 7 shows an exemplary embodiment of a blank with an opening facility already described as such, which blank is provided with recesses at desired positions in order to guarantee the airtightness of the box.

Needless to say, the invention also relates to a box obtained by the method according to any one of the preceding claims FIG. 7, finally, shows a blank P provided with a dispensing or pour opening already described as such, with the blank P provided with recesses 32, 38 made at the desired points. This embodiment is shown by way of example only, to indicate that different designs for dispensing or pour openings are possible in the method for obtaining an airtight and liquid-tight box.

It will be clear that the invention is not limited to the exemplary embodiment shown, but that various modifications are possible within the scope of the invention.

For instance, the end wall panels can be the top panels as well as the bottom panels. It is also possible that the end wall panels only form the bottom panels and that the top of the box is closed liquid-tightly and/or hermetically in a different manner, or the other way around. The material strip S can also be attached to the blank P through a sealing operation. The adhesive is then liberated by heating the material strip S and/or a coating of the blank P. According to the invention, the stamp with which the material strip S is heated should then have such dimensions that the adhesive or sealing material liberated by heating terminates at some distance from the edges of the adjacent end wall panels. In this case too, the positioning of the sealing stamp with respect to the blank P can occur with less accuracy, which enables mass production at a high production rate.

It will also be clear that the adhesive mentioned in the specification and the claims can also be one of the components of an epoxy, of which one component is applied to the entire surface of the material strip S and the other component is applied to the blank in the manner according to the invention as described.

I claim:

1. A method for manufacturing an airtight box from cardboard, wherein a blank is cut out which comprises sidewall panels which are mutually interconnected through sidewall fold lines, end wall panels which are attached to the sidewall panels via respective end wall fold lines, while the end wall panels are each bounded to two opposite free edges and a free end wall edge located opposite the end wall fold line; wherein after the blank has been cut out, along the end wall fold lines a flexible material strip is connected with the sidewall panels and a number of end wall panels through adhesion, which material strip is attached to each of a number of other end wall panels while leaving clear two triangular portions not provided with adhesive, located adjacent the free edges of the corresponding end panel wherein thereafter the blank is erected to form the box through folding and adhesion, characterized in that the adhesive for the purpose of adhering the material strips to the blank is applied in such a manner that the adhesive layer on the relevant end wall panel terminates at some distance from the edge of the adjacent end wall panel, recesses being provided at the location of the edges of the end wall panel which are adjacent to an adjacent end wall panel which recesses are so wide that adhesive for the purpose of attaching the material strip to the corresponding end wall panel is exposed at that point, and thereafter adhesive for the purpose of interconnecting the end wall panels is applied so as to be in communication with said exposed material strip attachment adhesive so as to form a glue dam for stopping air leakage and forming an airtight seal.

2. A method according to claim 1, characterized in that the recesses extend over the entire length of the edges of the corresponding end wall panels.

3. A method according to claim 1, characterized in that the distance between the edges of those end wall panels with which the material strip is connected is substantially equal to the distance between the sidewall fold lines or sidewall edge of the sidewall panel with which the corresponding end wall panel is connected, while each recess extends only over a part of the total length of the corresponding edge.

4. A method according to claim 1, characterized in that the blank is further provided with an adhesive panel which is connected via an adhesive panel fold line to a longitudinal edge of a sidewall located at a free end of the blank, by means of which adhesive panel the two sidewalls located at the free ends of the blank can be interconnected through adhesion, while also the adhesive panel is connected via an end wall fold line to at least one end wall panel with two opposite edges and a free end edge located opposite the end wall fold line, and the edge of the relevant end wall panel proximal to the adjacent end wall panel is farther provided with a recess of the above-mentioned type.

5. A method according to claim 1, characterized in that the blank is provided with four sidewall panels and, at least at one end, with four, first through fourth, end wall panels connected with the sidewall panels; wherein. first the sidewalls located at the ends of the blank are connected to each other, then the first and the third end wall panels with which the material strip is connected are folded inwards and the second and fourth end wall panels are folded outwards to some extent, then the adhesive for the purpose of interconnecting the end wall panels is applied and then the second end wall panel and, lastly, the fourth end wall panel are brought into the end position.

6. A method according to claim 5, characterized in that if the second end wall panel has a height corresponding with the width of the sidewall associated with the first and third end walls, this second end wall panel is provided at the free end edge thereof with two recesses, which prevents the exposed material strip adhesive from being covered as the second end wall panel is brought into the end position.

7. A box obtained by the method according to claim 1.

8. A method according to claim 2, characterized in that the blank is further provided with an adhesive panel which is connected via an adhesive panel fold line to a longitudinal edge of a sidewall located at a free end of the blank, by means of which adhesive panel the two sidewalls located at the free ends of the blank can be interconnected through adhesion, while also the adhesive panel is connected via an end wall fold line to at least one end wall panel with two opposite edges and a free end edge located opposite the end wall fold line, and the edge of the relevant end wall panel proximal to the adjacent end wall panel is further provided with a recess of the above-mentioned type.

9. A method according to claim 3, characterized in that the blank is further provided with an adhesive panel which is connected via an adhesive panel fold line to a longitudinal edge of a sidewall located at a free end of the blank, by means of which adhesive panel the two sidewalls located at the free ends of the blank can be interconnected through adhesion, while also the adhesive panel is connected via an end wall fold line to at least one end wall panel with two opposite edges and a free end edge located opposite the end wall fold line, and the edge of the relevant end wall panel proximal to the adjacent end wall panel is further provided with a recess of the above-mentioned type.

10. A method according to claim 2, characterized in that the blank is provided with four sidewall panels and, at least at one end, with four, first through fourth, end wall panels connected with the sidewall panels; wherein, first the sidewalls located at the ends of the blank are connected to each other, then the first and the third end wall panels with which the material strip is connected at least substantially completely are folded inwards and the second and fourth end wall panels are folded outwards to some extent, then the adhesive for the purpose of interconnecting the end wall panels is applied and then the second end wall panel and, lastly, the fourth end wall panel are brought into the end position.

11. A method according to claim 3, characterized in that the blank is provided with four sidewall panels and, at least at one end, with four, first through fourth, end wall panels connected with the sidewall panels; wherein, first the sidewalls located at the ends of the blank are connected to each other, then the first and the third end wall panels with which the material strip is connected at least substantially completely are folded inwards and the second and fourth end wall panels are folded outwards to some extent, then the adhesive for the purpose of interconnecting the end wall panels is applied and then the second end wall panel and, lastly, the fourth end wall panel are brought into the end position.

12. A method according to claim 4, characterized in that the blank is provided with four sidewall panels and, at least at one end, with four, first through fourth, end wall panels connected with the sidewall panels; wherein, first the sidewalls located at the ends of the blank are connected to each other, then the first and the third end wall panels with which the material strip is connected at least substantially completely are folded inwards and the second and fourth end wall panels are folded outwards to some extent, then the adhesive for the purpose of interconnecting the end wall panels is applied and then the second end wall panel and, lastly, the fourth end wall panel are brought into the end position.

13. A method according to claim 5, characterized in that the blank is provided with four sidewall panels and, at least at one end, with four, first through fourth, end wall panels connected with the sidewall panels; wherein, first the sidewalls located at the ends of the blank are connected to each other, then the first and the third end wall panels with which the material strip is connected at least substantially completely are folded inwards and the second and fourth end wall panels are folded outwards to some extent, then the adhesive for the purpose of interconnecting the end wall panels is applied and then the second end wall panel and, lastly, the fourth end wall panel are brought into the end position.

14. A method according to claim 6, characterized in that the blank is provided with four sidewall panels and, at least at one end, with four, first through fourth, end wall panels connected with the sidewall panels; wherein. first the sidewalls located at the ends of the blank are connected to each other, then the first and the third end wall panels with which the material strip is connected at least substantially completely are folded inwards and the second and fourth end wall panels are folded outwards to some extent, then the adhesive for the purpose of interconnecting the end wall panels is applied and then the second end wall panel and, lastly, the fourth end wall panel are brought into the end position.

* * * * *